United States Patent [19]

Kelley et al.

[11] 4,192,244

[45] Mar. 11, 1980

[54] METHOD OF MAKING CAN CLOSURES

[75] Inventors: John S. Kelley, Wenham, Mass.; Richard P. Moldas, Weirton, W. Va.

[73] Assignee: USM Corporation, Farmington, Conn.

[21] Appl. No.: 908,733

[22] Filed: May 23, 1978

[51] Int. Cl.[2] ..... B21D 51/44

[52] U.S. Cl. ..... 113/121 C; 220/268

[58] Field of Search ..... 113/121 C, 15 R, 15 A; 220/268

[56] References Cited

U.S. PATENT DOCUMENTS

| | | | |
|---|---|---|---|
| 3,760,752 | 9/1973 | Geiger | 113/121 C |
| 4,006,700 | 2/1977 | Lovell et al. | 113/121 C |
| 4,031,836 | 6/1977 | Grise et al. | 113/121 C |

*Primary Examiner*—Michael J. Keenan

*Attorney, Agent, or Firm*—Owen J. Meegan; Richard B. Megley; Vincent A. White

[57] ABSTRACT

A novel method of making an easy-open can end closure for insuring better control over the integrity of the closure, especially in tougher sheet metal such as steel, comprises the steps, after forming and longitudinally scoring-to-fracture the closure, of (a) providing a swageable strip of the metal extending along an edge of the line of fracture and overlying that edge, and (b) then swaging and dilating that strip radially into more intimate overlapping relation to the line of fracture to cause it to tightly close.

4 Claims, 4 Drawing Figures

Fig. 1
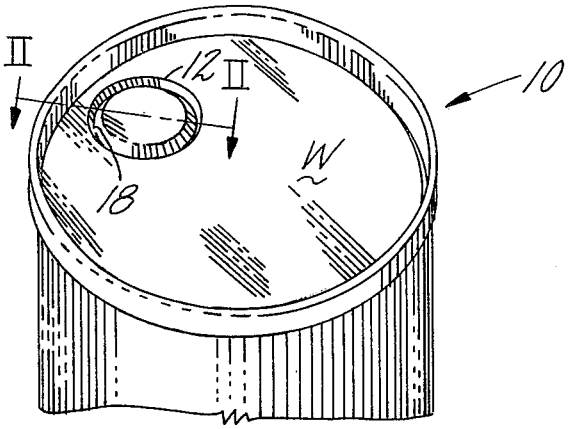
(Prior Art) Fig. 2
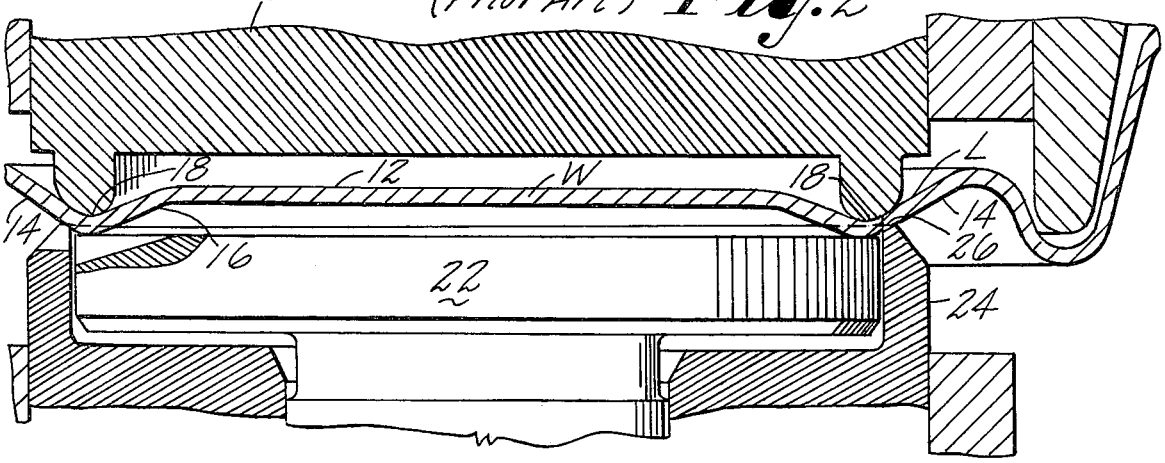
Fig. 3
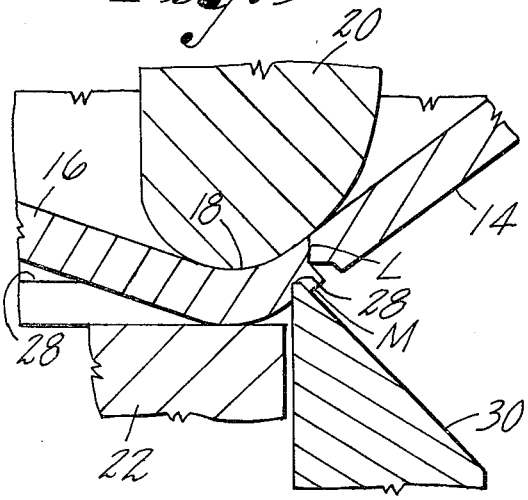
Fig. 4
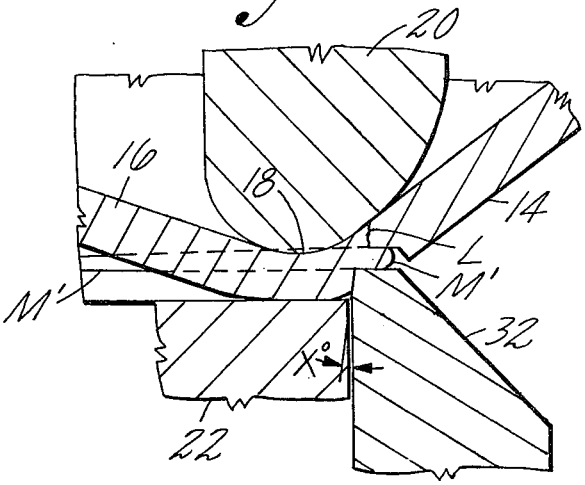

METHOD OF MAKING CAN CLOSURES

BACKGROUND OF THE INVENTION

This invention relates to an improved method of making easy-open closures in cans, especially those made of sheet metal. More particularly, the invention is concerned with providing a better technique, when a closure has been at least partly defined by a weakening line including scoring-to-fracture, for consistently attaining a manually rupturable fluid-tight metal seal along the line of fracture.

In U.S. Pat. No. 3,881,630 issued May 6, 1975 in the names of Walter C. Lovell and Frederick G. J. Grise, there is disclosed a can end of sheet metal wherein the periphery of its easy-open closure is characterized by a fractured yet integral section. FIG. 9 of that patent, for instance, and related description disclose a variant form of closure involving a so-called "double indent" or "W-type" wall formation considered to have especial merit when practiced with tougher sheet metals, for example steel.

In U.S. Pat. No. 4,031,836, also issued in the names of Messrs. Lovell and Grise, there is disclosed a mechanism for dilating rim material of a can closure into frangible sealing relation with a can cover. This patent U.S. Pat. No. 4,031,836, as noted for instance in FIG. 6 thereof, embodies a flat swaging surface for enlarging the closure rim, and a coining surface for thereupon impacting the dilated rim material adjacent to a weakening line. Such an arrangement has been found generally satisfactory when operating upon softer container materials such as aluminum, but is not normally fully acceptable or even at times, suitably operative for sealing when dealing with tougher sheet metal that is less apt to flow radially upon impact. The difficulty encountered appears to be that with little or no dilated material suitably available to be worked into overlapping relation to the fractured weakening line, or with little control over the extent and precise disposition of the dilated material relative to that line, inadequate or insufficiently uniform closure strength can be provided by the prior art swaging to effectively seal the frangible steel joint. Assurance of predictability of a closure's opening upon the exertion of a reasonable, substantially uniform digital pressure to a can is, of course, highly desirable for consumer acceptance.

SUMMARY OF THE INVENTION

In view of the foregoing it is an object of this invention to provide in tough sheet metal such as steel an improved method for insuring integrity of an easy-open container closure defined by a weakening line, especially such a line characterized by at least partial fracture in the sheet metal.

Another and more specific object of this invention is to provide a more reliable, yet simple, method for causing the median strip of a "double indent" or "W-type" fractured can closure to hermetically seal its joint with the remainder of the can and still remain easily openable by subsequent application of finger pressure.

To these ends, and as herein shown by way of illustration, after forming a section of a sheet metal can with wall portions meeting at the base of a channel and longitudinally scoring-to-fracture at least a portion of one of the walls to define a closure, two steps are taken in succession, namely (a) a swageable strip of the metal is provided in that wall extending along an edge of the line of fracture and at an angle to overlie that edge, and (b) the strip is then swaged to dilate it radially and force it to assume a greater angle and hence into a stronger and more intimate sealing relation with the fracture. The formation in one step of a swageable strip closely and uniformly adjacent to the fracture to be tightly sealed against fluid pressure, followed by the separate step of swaging the preformed strip to close the joint tightly constitute a novel and preferred method for producing reliable, easy-to-open can tops of sheet steel. Preferably the latter step is effected by a tool having a tapered working end which does not, at least not significantly, deform the sheet metal other than in its previously formed strip portion which is, in effect, pressed to flow into sealing relation to the fracture. This two-step approach succeeds with tougher sheet metal where the single step of the prior art failed to provide the minute precision of metal flow which consistent results in closure control demand.

BRIEF DESCRIPTION OF THE DRAWINGS

The foregoing and other features of the invention will now be more particularly described in connection with an illustrative embodiment and with reference to the accompanying drawings showing our novel method as practiced to produce one form of easy-open can closure. In the drawings:

FIG. 1 is a perspective view of one end of a can having an easy-open closure formed in one portion according to our novel method;

FIG. 2 is an enlarged section taken on the line II—II of FIG. 1 and showing cooperative dies initially forming the sheet metal with wall portions meeting at the base of a channel, and a scoring die indenting one of the walls to provide an integral fracture longitudinally therein;

FIG. 3 is a further enlarged sectional view showing formation, along an edge of the line of fracture, of a swageable strip projecting to at least partly overlie the frangible joint; and FIG. 4 is a view similar to FIG. 3 but showing the next step wherein a swaging of the just-formed strip forces it into tightly sealed relation to the joint.

DESCRIPTION OF THE PREFERRED EMBODIMENT

The novel method to be described is not limited in application to the making of can closures of any particular configuration or of any particular material, but is considered to be especially useful when applied to tough sheet metal, such as the steel used commonly in the making of "tin" cans.

Merely for purposes of illustration, a metal can end generally designated 10 in FIG. 1 is shown as having an easy-open circular closure 12 formed preferably in a section near a rim of the can. As illustrated in FIG. 2 the closure 12 comprises a largely planar section of the sheet metal W peripherally formed with wall portions 14,16 meeting at the base of a channel 18. Preferably as disclosed in U.S. Pat. No. 4,006,700, as the metal wall is thus being locally bowed by means comprising a forming die 20 and a lifter or cooperating knock-out 22, the tensioned non-public inside surface of the metal W is peripherally scored longitudinally by relative axial movement of a scoring tool 24. This tool 24 has a tapered exterior and a narrow flat upper scoring surface 26 adapted to indent and integrally fracture at the root of the indentation, but not separate, the metal W thus providing a weakening line L whereat rupture is to occur upon subsequent opening of the can as by mere finger pressure.

The line of fracture L is shown in FIG. 2 as peripherally extending not quite entirely around the closure 12, an unfractured locality remaining, preferably located away from the can rim, to serve as a hinge when the closure is opened. If it is desired to have the closure 12 wholly detached from the can end upon opening, the line L may extend a full 360°. Usually the hinge length need not be more than about ¼".

The scoring tool 24 having been relatively retracted, and the closure 12 remaining held between the die 20 and the knockout 22, the next step as shown in FIG. 3 is to form a swageable strip of metal M extending longitudinally immediately adjacent to and coextensive with the inside of the weakening line L. For this purpose a relatively sharp tool 30 axially straight on the inside, narrowly flattened at end 28 and tapered on the outside is relatively moved axially to penetrate the metal W at a spaced distance from the weakening line L to a depth commensurate with the final swage depth. The consequent wedge action starts the metal flow in a radially outward direction, the strip M being now precisely defined in location-desired thickness, and height and caused to at least partly overlie the inside edge of the weakening line L, as shown in FIG. 3.

Lastly, the tool 30 having been retracted while the closure remains clamped by the die 20 and the knockout 22, a second or locking swage 32 (FIG. 4) is operated on the preformed swageable strip M. The swage 32 is externally tapered, also has a preferably broader flatted working end, and notably is also preferably internally tapered away from the vertical. This enables the swage 32 more readily to "fold" the strip M further into its strengthened and fluid-tight sealing relation to the fractured weakening line L. It is found that without this separation and partial wedging or preforming of the swageable strip M, a conventional flat-bottomed swage tool merely pushes the metal directly ahead of it without providing the necessary metal flow for dependable sealing. At the other extreme it is found that usage of V-shaped, i.e. sharp-edged forming tools, is not advantageous in the practice of our method.

The locking swage 32 desirably has its internal taper at an angle X (FIG. 4) of from about 3 to 12 degrees to the vertical to provide suitable relief. Merely for purposes of indicating one example of a satisfactory arrangement, the finally dilated strip M, when "folded" into intimate sealing relation with the line of fracture as shown in FIG. 4 may have a thickness on the order of 0.0040 inches, when the thickness of the sheet W is in the order of 0.012 to 0.0135 inches.

Upon relative retraction of the forming tool 20, the can end 10 may be ejected by relative upward movement of the knock-out 22. The method described is repetitive at high rate for mass production of easy-open can ends. Of even greater significance and value is the fact that can closures 12 produced by the described two-step swaging method enables them to be made of steel sheet or the like and yet be uniformly openable from the exterior only by only moderate finger operating pressure. As has been indicated above, if the step shown in FIG. 3 were omitted when a steel can cover of easy-open type was to be produced, a swage (for instance such as shown at 32 in FIG. 4) would lack the nicely defined peripheral swageable strip M upon which to act to induce metal flow of the sort required for added strength and reliable sealing, and in fact would probably cause malformation of the weakening line L so as to prevent its subsequent opening by the use of predictable manual pressure. In contrast, usage of the swage 32 on the preformed, nicely defined strip M "folds" and flows it reliably into tightly locking relation across the inner edge of the line L. As will be apparent, no tab is required for opening the closure described.

Having thus described our invention what we claim as new and desire to secure as Letters Patent of the United States is:

1. The method of making a manually disruptable closure in a sheet metal can comprising forming a generally planar section thereof with wall portions meeting at the base of a channel to define the closure, longitudinally scoring at least one of the walls to provide a line of weakening therein, penetrating said one wall to provide a generally V-shaped line spaced radially inwardly of said weakening line to thereby form a defined strip of swageable metal commensurate with the depth of said scoring and integral with said one wall, and then swaging said strip to cause its metal to flow into intimate sealing relation with the weakening line.

2. A method of making an easy-open closure in a sheet metal container comprising forming a section of the container with peripheral wall portions meeting at the base of a channel, longitudinally scoring-to-fracture at least a portion of one of the walls to define a closure, penetrating said one wall to provide a generally V-shaped line spaced radially inwardly of said weakening line to thereby form a swageable strip extending therefrom to at least partly overlie said edge, and then swaging said strip or the projecting portion thereof to radially dilate it into more intimate and strengthened sealing relation with the fracture of said one wall.

3. A method as in claim 2 wherein the strip forming step and the final swaging step are effected by coaxially operating tools having external tapered work engaging ends respectively flatted, the end of the final swaging tool being broader and having an internal relief angle of 3°–12°.

4. The method of making an easy-open closure in a sheet metal can end which consists in first bending peripheral wall portions of the closure to meet in a sectionally rounded channel defined by means comprising a forming die mating with the channel and opposing die engaging the non-public or inside surface of the closure, and, while the closure is thus being formed, longitudinally indenting and scoring-to-fracture said wall portions on the outer side of the base of said channel, then, while the can end remains held by the dies, forming a swageable strip in said inside surface of the closure by penetrating said wall portions to provide a generally V-shaped line spaced radially inwardly of said fractured wall portion, the strip being coextensive with the fracture and substantially uniformly inclined over an edge thereof, and lastly, while the can end is held by said dies, swaging said inclined strip to further dilate it into locking relation with the fracture.

* * * * *